US011585578B2

(12) United States Patent
Ito et al.

(10) Patent No.: US 11,585,578 B2
(45) Date of Patent: Feb. 21, 2023

(54) REFRIGERATION CYCLE APPARATUS

(71) Applicant: Mitsubishi Electric Corporation, Tokyo (JP)

(72) Inventors: Masahiro Ito, Tokyo (JP); So Nomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 214 days.

(21) Appl. No.: 16/606,868

(22) PCT Filed: Jul. 7, 2017

(86) PCT No.: PCT/JP2017/024958
§ 371 (c)(1),
(2) Date: Oct. 21, 2019

(87) PCT Pub. No.: WO2019/008742
PCT Pub. Date: Jan. 10, 2019

(65) Prior Publication Data
US 2020/0318880 A1 Oct. 8, 2020

(51) Int. Cl.
*F25B 47/02* (2006.01)
*F25B 13/00* (2006.01)

(52) U.S. Cl.
CPC ..... *F25B 47/02* (2013.01); *F25B 13/00* (2013.01); *F25B 2313/003* (2013.01)

(58) Field of Classification Search
CPC .... F25B 47/02; F25B 13/00; F25B 2313/003; F25B 47/022
See application file for complete search history.

(56) References Cited

U.S. PATENT DOCUMENTS 6,012,294 A * 1/2000 Utsumi ..... F25B 41/20 62/81
2005/0172648 A1* 8/2005 Concha ..... F25B 47/022 62/150
2008/0092568 A1* 4/2008 Ookoshi ..... F24D 17/02 62/151
(Continued)

FOREIGN PATENT DOCUMENTS

JP 2008-096033 A 4/2008
WO 2011/108237 A1 9/2011
(Continued)

OTHER PUBLICATIONS

Admiraal, D.M., & Bullard C.W. (1993). Heat Transfer in Refrigerator Condenser and Evaporators ACRC Project 12 Analysis of Refrigerator-Freezer Systems, ACRC TR-48, 1-58. (Year: 1993).*
(Continued)

*Primary Examiner* — Christopher R Zerphey
(74) *Attorney, Agent, or Firm* — Posz Law Group, PLC

(57) ABSTRACT

A refrigeration cycle apparatus includes an indoor heat exchanger, a water heat exchanger, a pump, an outdoor heat exchanger, a compressor, an expansion valve, a four-way valve, a third pipe, and an open/close valve, and configured to enable hot-gas defrosting and reverse cycle defrosting. A controller selects, based on the indoor load, either one of the hot-gas defrosting and the reverse cycle defrosting to be performed. In this way, defrosting can be performed with a minimum decrease of the chiller water temperature.

8 Claims, 9 Drawing Sheets

(56) References Cited

U.S. PATENT DOCUMENTS

| | | | | |
|---|---|---|---|---|
| 2012/0291460 | A1* | 11/2012 | Aoyagi | F25B 40/00 62/151 |
| 2015/0292786 | A1 | 10/2015 | Andersson | |
| 2015/0330674 | A1* | 11/2015 | Yamashita | F25B 7/00 62/160 |
| 2016/0273816 | A1* | 9/2016 | Horiuchi | F25B 47/025 |
| 2016/0305702 | A1 | 10/2016 | Nikaido et al. | |
| 2017/0038125 | A1 | 2/2017 | Tani et al. | |

FOREIGN PATENT DOCUMENTS

| | | | |
|---|---|---|---|
| WO | 2015/129128 | A1 | 9/2015 |
| WO | 2015/162696 | A1 | 10/2015 |

OTHER PUBLICATIONS

International Search Report of the International Searching Authority dated Oct. 3, 2017 for the corresponding International application No. PCT/JP2017/024958 (and English translation).

The Extended European Search Report dated Nov. 23, 2020 in corresponding to EP application No. 17917003.0.

The partial supplementary European Search Report dated Aug. 3, 2020 issued in corresponding EP application No. 17917003.0.

* cited by examiner

REFRIGERATION CYCLE APPARATUS

CROSS REFERENCE TO RELATED APPLICATION

This application is a U.S. national stage application of International Application PCT/JP2017/024958 filed on Jul. 7, 2017, the contents of which are incorporated herein by reference.

TECHNICAL FIELD

The present invention relates to a refrigeration cycle apparatus, and particularly relates to a refrigeration cycle apparatus configured to perform a defrosting operation.

BACKGROUND

A refrigeration cycle apparatus is known to require a defrosting operation in some cases. For example, in an air conditioner, frost may form on an outdoor heat exchanger during a heating operation to block an air passage between fins, and therefore, the frosted state is checked regularly to perform a defrosting operation as required.

WO2015/162696 (PTL 1) discloses a refrigerant circuit capable of both hot-gas defrosting and reverse cycle defrosting, for which the defrosting method is switched depending on the amount of formed frost.

Patent Literature

PTL 1: WO2015/162696

According to studies by the inventors of the present application, a decrease of the water temperature during defrosting in a chiller (including a water heat exchanger and using water as a liquid medium to perform indoor air conditioning) depends on the indoor load and/or the amount of water used in the system, and it has therefore been found that an optimum defrosting method cannot be determined from only the amount of formed frost. If an optimum defrosting method cannot be determined, a decrease of the temperature of water circulating through an indoor heat exchanger during heating is greater than that when an optimum defrosting method is used, which may make users uncomfortable.

SUMMARY

An object of the present invention is to provide a refrigeration cycle apparatus capable of performing defrosting with a minimum decrease of the chiller water temperature.

A refrigeration cycle apparatus of the present disclosure includes a water heat exchanger, a refrigeration cycle circuit, and a liquid medium circulation circuit. The water heat exchanger causes heat to be exchanged between refrigerant and a liquid medium. The refrigeration cycle circuit connects a compressor, the water heat exchanger, an expansion valve, and an outdoor heat exchanger successively, and connects a discharge side of the compressor to a part of the refrigeration cycle circuit between the expansion valve and the outdoor heat exchanger. The liquid medium circulation circuit connects the water heat exchanger, a pump, and an indoor heat exchanger.

The refrigeration cycle circuit includes: a four-way valve configured to switch to connect the compressor to the water heat exchanger or to connect the compressor to the outdoor heat exchanger; a pipe connecting the discharge side of the compressor to the part of the refrigeration cycle circuit between the expansion valve and the outdoor heat exchanger; and a valve configured to block flow of the refrigerant in the pipe. The refrigeration cycle apparatus performs, based on an indoor load, a defrosting operation that is either one of a first defrosting operation of opening the valve, connecting the compressor to the water heat exchanger, and allowing refrigerant discharged from the compressor to flow to the outdoor heat exchanger, and a second defrosting operation of closing the valve, connecting the compressor to the outdoor heat exchanger, and allowing refrigerant discharged from the compressor to flow to the outdoor heat exchanger.

The present invention selects a defrosting mode in which defrosting can be performed with a minimum decrease of the chiller water temperature.

DETAILED DESCRIPTION

Figure 1:
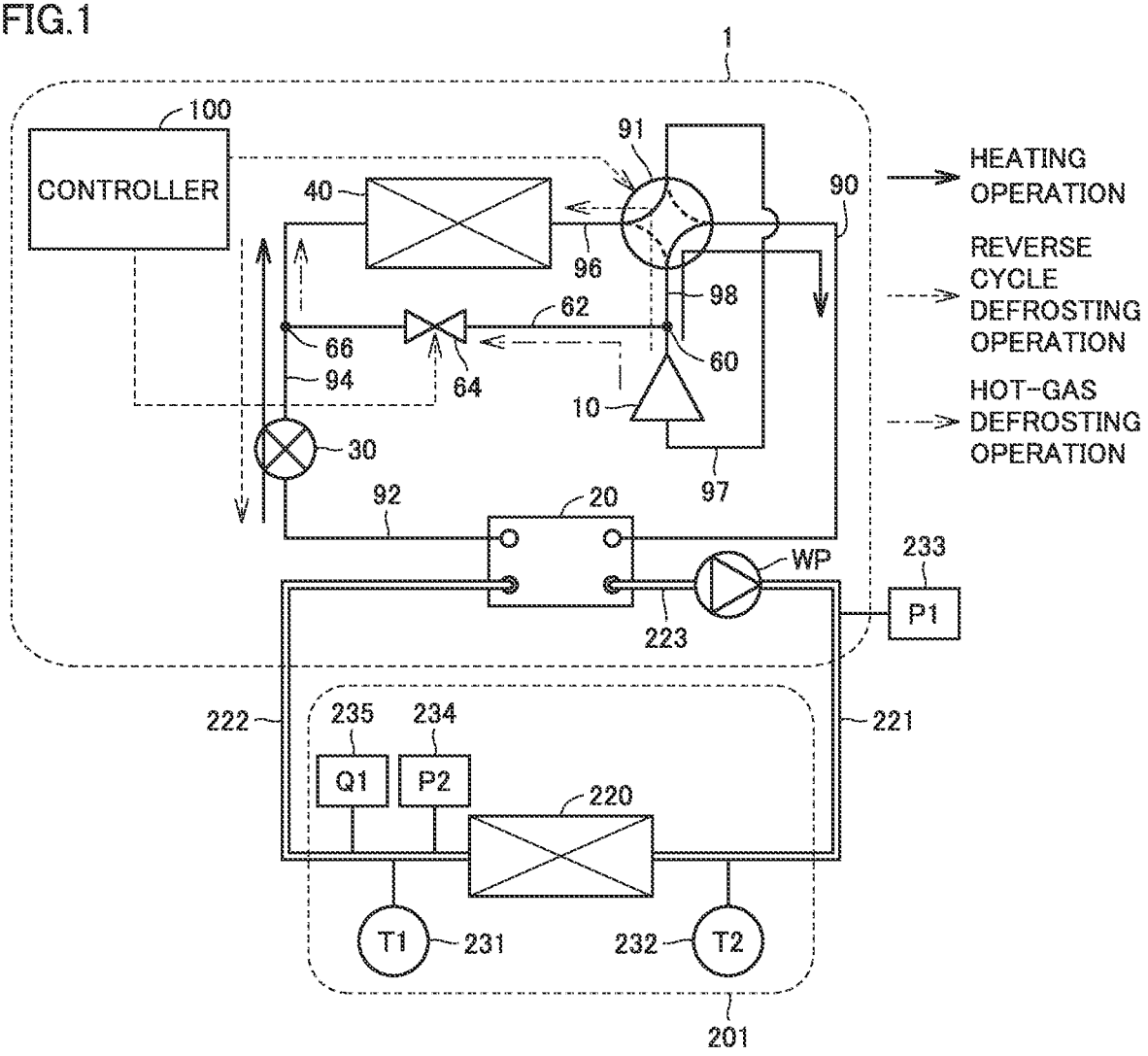
FIG. 1 is an overall configuration diagram of a refrigeration cycle apparatus according to Embodiment 1.

Embodiments of the present invention are described in detail hereinafter with reference to the drawings. In the following, a plurality of embodiments are described. It is intended originally at the time of filing of the application that features described in connection with the embodiments may be combined as appropriate. In the drawings, the same or corresponding components are denoted by the same reference characters.

Embodiment 1

FIG. 1 is an overall configuration diagram of a refrigeration cycle apparatus according to Embodiment 1. Referring to FIG. 1, the refrigeration cycle apparatus includes an outdoor unit 1 and an indoor unit 201. Outdoor unit 1 includes a compressor 10, a water heat exchanger 20, an expansion valve 30, an outdoor heat exchanger 40, pipes 62, 90, 92, 94, 96, 97, 98, a four-way valve 91, an open/close valve 64, and a controller 100. Outdoor unit 1 further includes a refrigeration cycle circuit connecting compressor 10, water heat exchanger 20, expansion valve 30, and outdoor heat exchanger 40 successively by pipes 90, 92, 94, 96, 97, 98, and connecting, by pipe 62, a discharge side of compressor 10 to a part of the refrigeration cycle circuit between expansion valve 30 and outdoor heat exchanger 40.

Pipe 90 connects four-way valve 91 to water heat exchanger 20. Pipe 92 connects water heat exchanger 20 to expansion valve 30. Pipe 94 connects expansion valve 30 to outdoor heat exchanger 40. Pipe 96 connects outdoor heat exchanger 40 to four-way valve 91. A discharge outlet of compressor 10 is connected by pipe 98 to the four-way valve, and a suction inlet of compressor 10 is connected by pipe 97 to four-way valve 91.

A refrigerant passage connecting water heat exchanger 20 to outdoor heat exchanger 40 includes pipe 92 and pipe 94. Expansion valve 30 is disposed at the boundary between pipe 92 and pipe 94.

Outdoor heat exchanger 40 is configured to exchange heat between refrigerant and outdoor air. Water heat exchanger 20 is configured to exchange heat between water and refrigerant.

Compressor 10 is configured to have its operating frequency variable in accordance with a control signal received from controller 100. The operating frequency of compressor 10 is changed to adjust the output of compressor 10.

For a heating operation, four-way valve 91 connects the discharge outlet of compressor 10 to pipe 90 so as to cause refrigerant to flow in the order from compressor 10 to water heat exchanger 20 in the direction indicated by solid-line arrows, and also connects the suction inlet of compressor 10 to pipe 96. For a cooling operation or reverse cycle defrosting operation, four-way valve 91 connects the discharge outlet of compressor 10 to pipe 96 so as to cause refrigerant to flow in the order from compressor 10 to outdoor heat exchanger 40 in the direction indicated by broken-line arrows, and also connects the suction inlet of compressor 10 to pipe 90.

In other words, four-way valve 91 is configured to switch the refrigerant flow direction between a first direction (heating) and a second direction (cooling, reverse cycle defrosting). The first direction (heating) is a flow direction for feeding refrigerant discharged from compressor 10 to water heat exchanger 20 and returning refrigerant from outdoor heat exchanger 40 back to compressor 10. The second direction (cooling, reverse cycle defrosting) is a flow direction for feeding refrigerant discharged from compressor 10 to outdoor heat exchanger 40 and returning refrigerant from water heat exchanger 20 back to compressor 10.

Pipe 62 connects a branching portion 60 located on pipe 98 which is a discharge side pipe of compressor 10, to a confluence portion 66 located on pipe 94. Pipe 62 is a flow passage bypassing water heat exchanger 20 and expansion valve 30. Open/close valve 64 is disposed in pipe 62 and configured to have its degree of opening adjusted in accordance with a control signal received from controller 100 for adjusting the amount of refrigerant flowing through pipe 62. Open/close valve 64 may be a simple valve for performing opening/closing operation only.

The refrigeration cycle apparatus in FIG. 1 has indoor unit 201 including a liquid medium circulation circuit. The liquid medium circulation circuit includes an indoor heat exchanger 220, a liquid pump WP, and water pipes 221 to 223 serving as pipes for circulating water in the order of water heat exchanger 20, liquid pump WP, and indoor heat exchanger 220, and also includes temperature sensors 231, 232, a pressure sensor 234, and a flow rate sensor 235. The liquid medium circulation circuit connects water heat exchanger 20, liquid pump WP, and indoor heat exchanger 220 to each other.

Water pipe 221 connects liquid pump WP to indoor heat exchanger 220, water pipe 222 connects indoor heat exchanger 220 to water heat exchanger 20, and water pipe 223 connects water heat exchanger 20 to indoor heat exchanger 220. Temperature sensor 231 is a sensor disposed at the outlet of indoor heat exchanger 220 for detecting the temperature of water flowing out from indoor heat exchanger 220, and temperature sensor 232 is a sensor disposed at the inlet of indoor heat exchanger 220 for detecting the temperature of water flowing into indoor heat exchanger 220.

Pressure sensor 234 is a sensor disposed at the outlet of indoor heat exchanger 220 for detecting the pressure of water flowing out from indoor heat exchanger 220, and flow rate sensor 235 is a sensor disposed at the outlet of indoor heat exchanger 220 for detecting the flow rate of water. Indoor heat exchanger 220 is configured to exchange heat between indoor air and water circulating through water pipes 221 to 223.

Pressure sensor 234 detects pressure P2 of water at the outlet of indoor heat exchanger 220, and outputs the detected value to controller 100. Temperature sensor 231 detects water temperature T1 at the outlet of indoor heat exchanger 220, and outputs the detected value to controller 100. Temperature sensor 232 detects water temperature T2 at the inlet of indoor heat exchanger 220, and outputs the detected value to controller 100. Flow rate sensor 235 is disposed at the outlet of indoor heat exchanger 220, detects flow rate Q1 of water, and outputs the detected value to controller 100.

Controller 100 includes a CPU (Central Processing Unit), a storage device, and an input/output buffer, for example (they are not shown), for controlling each device in the refrigeration cycle apparatus. This control is not limited to processing by software but may be processing by a dedicated hardware (electronic circuit).

First, a basic operation of heating is described. During the heating operation, refrigerant flows in outdoor unit 1 as indicated by the solid-line arrows and the solid-line flow path in four-way valve 91. Refrigerant flowing in pipe 96 is sucked through four-way valve 91 into compressor 10, and compressor 10 compresses the sucked refrigerant to discharge the compressed refrigerant to pipe 90 through four-way valve 91.

The refrigerant discharged from compressor 10 is overheated vapor of high temperature and high pressure. In water heat exchanger 20, the refrigerant exchanges heat with water which is a liquid medium flowing in indoor unit 201, and the refrigerant is then condensed into liquid form. At this time, the temperature of water flowing in indoor unit 201 is increased by the heat discharged from the refrigerant.

After this, the refrigerant liquefied in water heat exchanger 20 is lowered in pressure by expansion valve 30. Expansion valve 30 is configured to have its degree of opening adjustable in accordance with a control signal received from controller 100. As the degree of opening of expansion valve 30 is changed in the close direction, the refrigerant pressure at the outlet of expansion valve 30 decreases and the refrigerant dryness increases. In contrast, as the degree of opening of expansion valve 30 is changed in the open direction, the refrigerant pressure at the outlet of expansion valve 30 increases and the refrigerant dryness decreases.

The refrigerant lowered in pressure by expansion valve 30 flows into outdoor heat exchanger 40 to exchange heat with outdoor air in outdoor heat exchanger 40. The refrigerant is then evaporated into overheated vapor that flows through pipe 97 into the compressor.

The water (hot water) having the temperature increased through water heat exchanger 20 in indoor unit 201 is delivered to indoor heat exchanger 220 by liquid pump WP. The hot water delivered by liquid pump WP exchanges heat, in indoor heat exchanger 220, with indoor air. The heat discharged from the hot water into the inside air is used to heat the inside of a room.

Moreover, in order to melt frost formed on outdoor heat exchanger 40 during the heating operation, a defrosting operation may be selected from a hot-gas defrosting operation and a reverse cycle defrosting operation. The hot-gas defrosting operation is an operation for melting frost formed on outdoor heat exchanger 40 by feeding, directly to outdoor heat exchanger 40, the overheated vapor of high temperature and high pressure discharged from compressor 10, with a similar setting of four-way valve 91 to that during the heating operation. The reverse cycle defrosting operation is described later herein.

The setting for four-way valve 91 during the hot-gas defrosting operation is also similar to that during the heating operation. During the hot-gas defrosting operation, the direction in which refrigerant flows is basically similar to that during the heating operation. However, the flow passage resistance in the flow passage through water heat exchanger 20 and expansion valve 30 is larger than the flow passage resistance in pipe 62. Therefore, as open/close valve 64 is opened, most of the refrigerant discharged from compressor 10 flows to pipe 62 as indicated by the arrow of an alternate long and short dashed line, and some of the refrigerant flows to pipe 90.

Next, a cooling operation is described. During the cooling operation, four-way valve 91 forms a passage indicated by broken lines in outdoor unit 1, and refrigerant flows in the direction indicated by the broken-line arrows. Specifically, refrigerant discharged from compressor 10 flows through outdoor heat exchanger 40, expansion valve 30, and water heat exchanger 20 in this order. As a result, water heat exchanger 20 acts as an evaporator and outdoor heat exchanger 40 acts as a condenser. Accordingly, heat is absorbed from water in water heat exchanger 20, and discharged from the outdoor unit to outdoor air.

A reverse cycle defrosting operation may be selected as a defrosting operation in order to melt frost formed on outdoor heat exchanger 40 during the heating operation. The reverse cycle defrosting operation is an operation for melting frost formed on outdoor heat exchanger 40 by feeding, to outdoor heat exchanger 40, overheated vapor of high temperature and high pressure discharged from compressor 10, with the same setting of four-way valve 91 as that during the cooling operation. During the reverse cycle defrosting operation, the setting of four-way valve 91 and the direction in which refrigerant flows are similar to those during the cooling operation, and in addition the open/close valve 64 is closed.

Controller 100 controls switching of four-way valve 91 based on whether the apparatus is set in the cooling mode or the heating mode, controls operation of compressor 10 in response to an operational instruction for compressor 10, and controls stoppage of compressor 10 in response to an instruction to stop compressor 10. Moreover, controller 100 controls the operating frequency of compressor 10, the degree of opening of expansion valve 30, and the rotational speed of an indoor fan and an outdoor fan (not shown), so that the refrigeration cycle apparatus exhibits a desired performance.

Controller 100 also selects one of a reverse cycle defrosting mode and a hot-gas defrosting mode as a defrosting mode for performing the defrosting operation, depending on the magnitude of the indoor load. In the reverse cycle defrosting mode, controller 100 controls four-way valve 91 so that refrigerant flows in the second direction which is the same as that in the cooling operation, and closes open/close valve 64. In contrast, in the hot-gas defrosting mode, controller 100 controls four-way valve 91 so that refrigerant flows in the first direction which is the same as that in the heating operation, and opens open/close valve 64.

Figure 2:
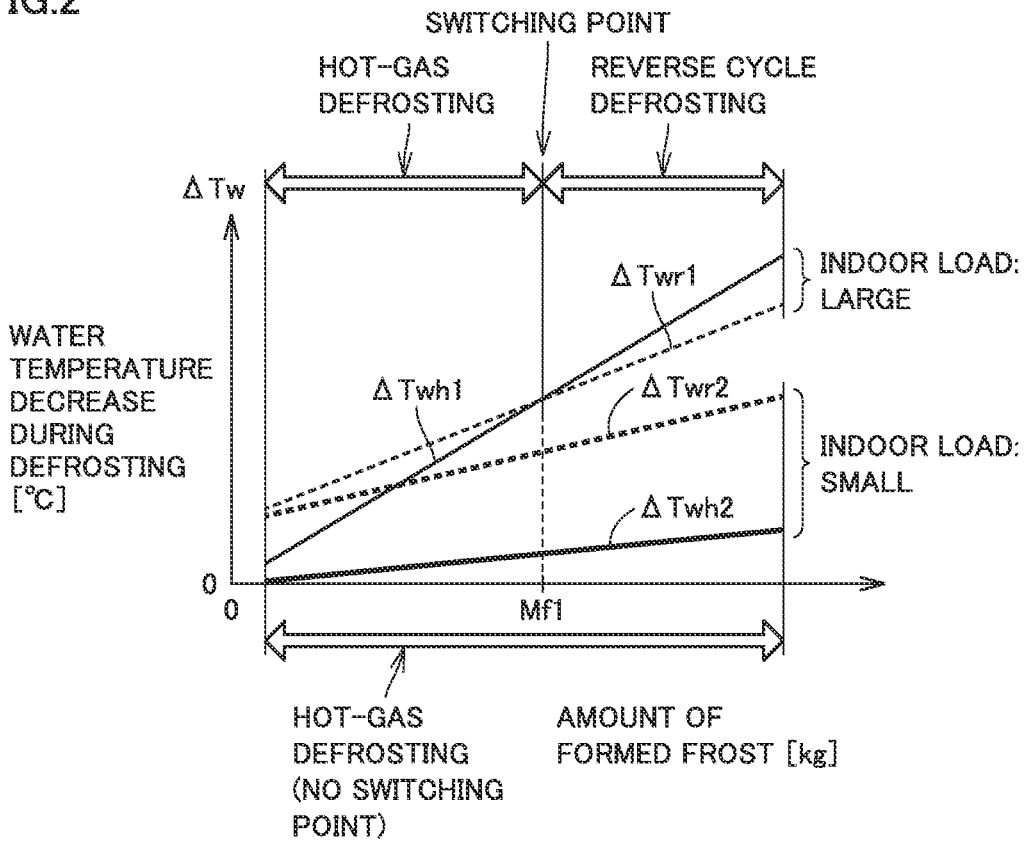
FIG. 2 illustrates switching between hot-gas defrosting and reverse cycle defrosting.

FIG. 2 illustrates switching between hot-gas defrosting and reverse cycle defrosting. As shown in FIG. 2, when the indoor load is large, the refrigeration cycle apparatus according to the present embodiment is controlled to switch between different defrosting modes at the point where the amount of formed frost is Mf1.

The water temperature decrease during the defrosting operation when the indoor 20 load is large is ΔTwr1 in the case of reverse cycle defrosting, and DTwh1 in the case of hot-gas defrosting. A smaller water temperature decrease gives less discomfort to users. Then, where a relationship: the amount of formed frost <Mf1 is satisfied, ΔTwr1>ΔTwh1 holds, and therefore, controller 100 selects the hot-gas defrosting mode. Where a relationship: the amount of formed frost >Mf1 is satisfied, ΔTwr1<ΔThr1 holds, 25 and therefore, controller 100 selects the reverse cycle defrosting.

Supposing that the position of the amount of formed frost Mf1 representing this switching point is unchanged, a defrosting mode is selected based on the amount of formed frost for performing the defrosting operation at regular intervals, which is a technique corresponding to the technique disclosed in WO2015/162696 (PTL 1).

In the hot-gas defrosting mode, almost no refrigerant gas is passed through water heat exchanger 20, which produces an advantage that cooling by refrigerant gas in water heat exchanger 20 does not occur during defrosting. In contrast, the reverse cycle defrosting mode exhibits a higher defrosting effect and therefore, defrosting is completed in a shorter time. When the indoor load is large, a longer time taken for defrosting is disadvantageous to the hot-gas defrosting method, because the temperature of water circulating through water heat exchanger 20 may decrease greater than the reverse cycle defrosting. For these reasons, the amount of formed frost Mf1 is located at the position on the horizontal axis where the water temperature decrease represented by the vertical axis in FIG. 2 is the same for the two defrosting modes.

Change of the indoor load, however, causes change of the position of the amount of formed frost Mf1 representing the switching point. When the indoor load is lower than a certain value, the water temperature decrease during the defrosting operation is ΔTwr2 in the case of the reverse cycle defrosting, and ΔTwh2 in the case of the hot-gas defrosting. In this case, there is no intersection of the two graphs, and ΔTwr2>ΔTwh2 always holds. Then, the hot-gas defrosting mode is selected for the defrosting operation. When the indoor load is small and the defrosting mode is switched to the reverse cycle defrosting at the position of the amount of formed frost Mf1 similar to that for the larger indoor load as described above, the water temperature decrease is larger than ΔTwh2 of the hot-gas defrosting, which may give discomfort to users.

In consideration of the foregoing, the water temperature decrease during defrosting in a chiller (including a water heat exchanger and using water for indoor air conditioning) depends on the indoor load, and therefore, an optimum defrosting mode cannot be determined from only the amount of formed frost. Specifically, according to the results of studies (results of calculations) by the inventors, it has been found that, in order to minimize the water temperature decrease in the chiller, the defrosting mode is switched from the hot-gas defrosting to the reverse cycle defrosting as the amount of formed frost increases in the case of a large indoor load, because this can suppress the water temperature decrease, while the hot-gas defrosting causes a smaller water temperature decrease than the reverse cycle defrosting even when the amount of formed frost increases in the case of a small indoor load.

In the present embodiment, therefore, when the defrosting operation is to be started, the water temperature decreases are calculated, depending on the amount of formed frost and the indoor load, supposing that the defrosting operation is performed in one of two defrosting modes, and a defrosting mode giving a smaller water temperature decrease is selected to perform the defrosting operation.

Figure 3:
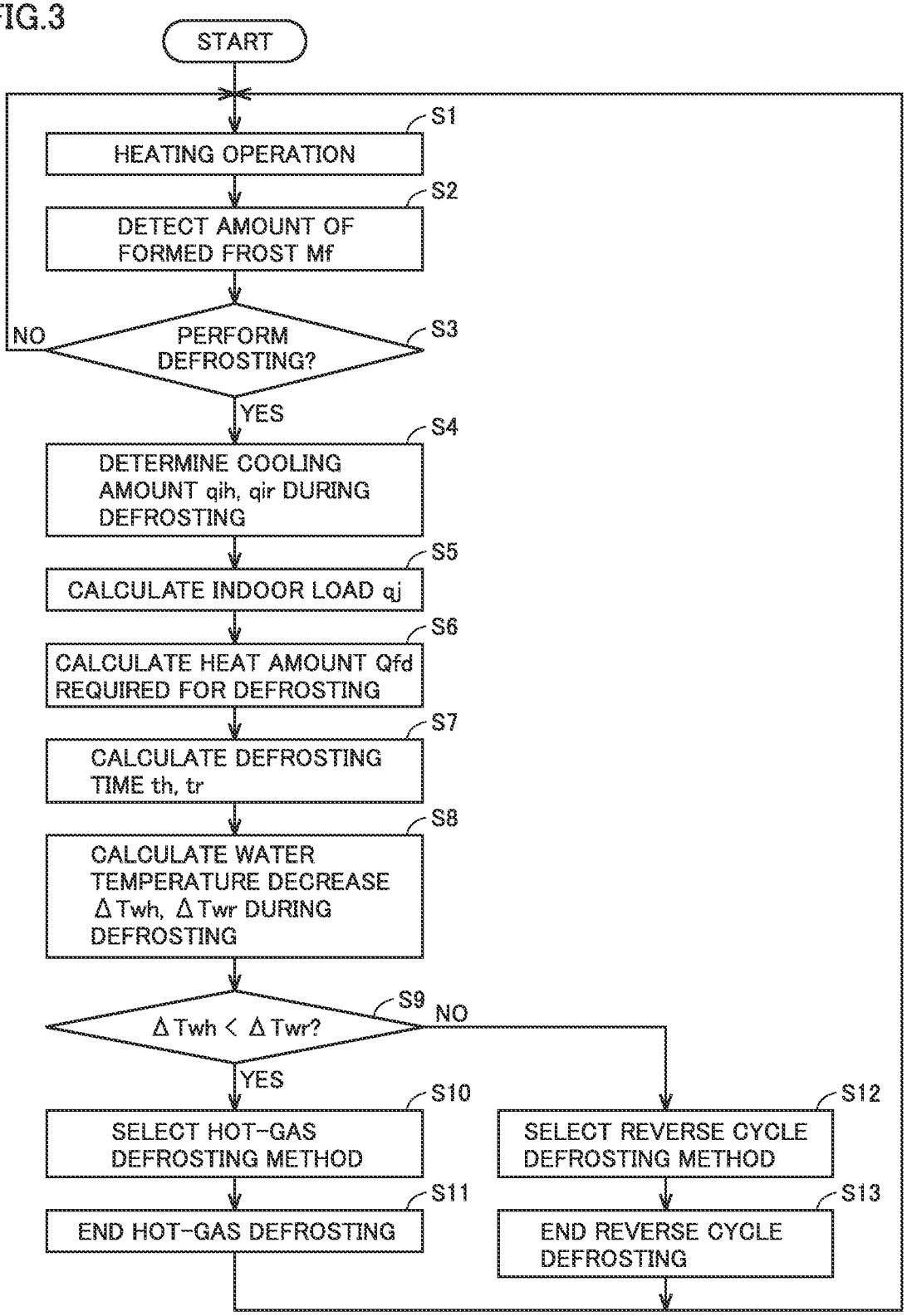
FIG. 3 is a flowchart for illustrating control performed by a controller in Embodiment 1.

FIG. 3 is a flowchart for illustrating control performed by the controller in Embodiment 1. Referring to FIG. 3, the process of this flowchart is started in response to a heating operation start command from a user or a timer device, for example, and the heating operation is performed first in step S1. Subsequently, in step S2, amount of formed frost Mf of outdoor heat exchanger 40 is detected.

Amount of formed frost Mf may be detected in any manner. For example, it can be detected by a frost amount sensor. The frost amount sensor applies light between fins of outdoor heat exchanger 40, and determines that frost is formed when the light is weakened (blocked). More than one monitoring site may be specified to estimate the area where frost is formed, relative to the total area. The relation between the rotational speed of a fan disposed in outdoor heat exchanger 40 and the quantity of air supplied by the fan may also be used. With formation of frost, the air resistance increases. Therefore, in order to produce the same quantity of air, the fan is rotated at a higher rotational speed.

Subsequently, controller 100 determines in step S3 whether to perform the defrosting operation or not. For example, it may determine to perform the defrosting operation when the amount of formed frost Mf exceeds a predetermined decision value. Alternatively, it may determine to perform the defrosting operation when a predetermined time has elapsed since completion of the preceding defrosting operation. When it is determined in step S3 that the defrosting operation is not to be performed (NO in S3), the process is performed again from step S1.

When it is determined in step S3 that the defrosting operation is to be performed (YES in S3), cooling amount qih, qir during defrosting is determined in step S4, and indoor load qj is calculated in step S5.

Figure 4:
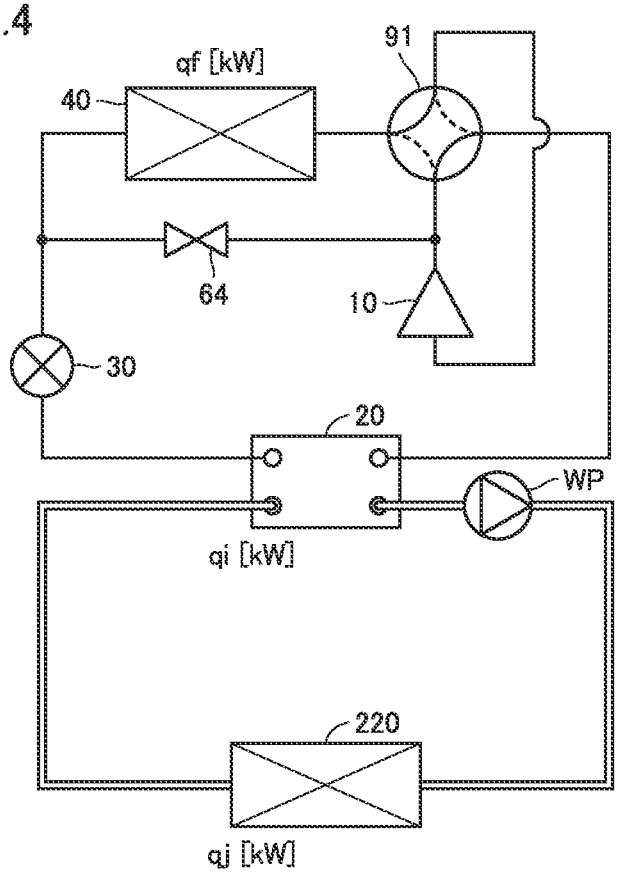
FIG. 4 illustrates the cooling amount and the indoor load.

FIG. 4 illustrates the cooling amount and the indoor load. The diagram shown in FIG. 4 is depicted by extracting a refrigerant circulation path and a water circulation path from FIG. 1. Cooling amount qi [kW] during defrosting represents the amount of heat for cooling water in water heat exchanger during the defrosting operation, qih represents the cooling amount during the hot-gas defrosting, and qir represents the cooling amount during the reverse cycle defrosting.

Controller 100 calculates indoor load qj in accordance with the following formula (1).

$$qj=Q1*(T1-T2)*Cpw \quad (1)$$

In the above formula, qj [kW] represents the indoor load, Q1 [kg/s] represents the flow rate of a liquid medium, T1 [° C.] represents the inlet temperature at the inlet of indoor heat exchanger 220, T2 [° C.] represents the outlet temperature at the outlet of indoor heat exchanger 220, and Cpw [kJ/kg° C.] represents the specific heat of water.

Subsequently, in step S6, controller 100 calculates heat amount Qfd [kJ/kg] required for defrosting, in accordance with the following formula (2).

$$Qfd=Mf*C \quad (2)$$

In the above formula, Mf represents the amount of formed frost [kg] detected in step S2, and C represents the latent heat of fusion of ice (constant=334 [kJ/kg]).

Subsequently, in step S7, controller 100 calculates defrosting time th, tr in accordance with the following formula (3), where th represents the defrosting time required for hot-gas defrosting, and tr represents the defrosting time required for reverse cycle defrosting.

$$t=Qfd/qf \quad (3)$$

In formula (3), Qfd represents the heat amount [kJ/kg] required for defrosting that is determined in accordance with formula (2), and of represents the amount of heat applied for defrosting that is a design value. Here, qfh<qfr holds, where qfh represents the amount of heat applied for hot-gas defrosting, and qfr represents the amount of heat applied for reverse cycle defrosting, and qfh/qfr is approximately ⅓.

Subsequently, in step S8, controller 100 calculates water temperature decrease ΔTwh, ΔTwr during defrosting, in accordance with the following formula (4), where ΔTwh represents the water temperature decrease during hot-gas defrosting, and ΔTwr represents the water temperature decrease during reverse cycle defrosting.

$$\Delta Tw=k*(qj-qi)*t/M \quad (4)$$

In Formula (4), qj represents the indoor load [kW] calculated in step S5, qi represents the cooling amount [kW] during defrosting determined in step S4, t represents the defrosting time [s] calculated in step S7, M represents the total amount of water circulated by liquid pump WP (system-used water amount, i.e., the amount of water used in the system), and k represents a coefficient. System-used water amount M is a fixed value in Embodiment 1.

In step S9, controller 100 compares water temperature decrease ΔTwh during hot-gas defrosting with water temperature decrease ΔTwr during reverse cycle defrosting. When water temperature decrease ΔTwh during hot-gas defrosting is smaller (YES in S9), the process proceeds to step S10 in which controller 100 selects the hot-gas defrosting method to start defrosting. Then, in step S11, the hot-gas defrosting is ended after the operation for hot gas defrosting time th.

In contrast, when water temperature decrease ΔTwh during hot-gas defrosting is larger in step S9 (NO in S9), the process proceeds to step S12 in which controller 100 selects the reverse cycle defrosting method to start defrosting. Then, in step S13, the reverse cycle defrosting is ended after the operation for reverse cycle defrosting time tr.

When one of the defrosting methods is completed in step S11 or S13, the process is performed again from step S1.

As seen from the foregoing, hot-gas defrosting and reverse cycle defrosting are different from each other in terms of amount of heat of applied for defrosting and cooling amount qi during defrosting (qfh<qfr, qih<qir), and therefore, the water temperature decrease during defrosting varies depending on the defrosting method. In Embodiment 1, water temperature decrease ΔT during each of the two defrosting operations is calculated from the operating state immediately before defrosting, and a defrosting method with smaller ΔT is selected. Thus, the water temperature decrease can be minimized.

Embodiment 2

In the above description of Embodiment 1, a defrosting mode is selected based on the indoor load. In connection with Embodiment 2, a description is given of control under which a defrosting mode is selected based further on system-used water amount M in addition to indoor load qj.

System-used water amount M is the total amount of water circulated in a water pipe in a building, from a chiller through a liquid pump. After the building has been constructed and an air conditioning apparatus has been installed in the building, system-used water amount M is basically a fixed value that remains unchanged. However, for each building in which an air conditioning apparatus is installed, system-used water amount M may take a different value. It is therefore necessary, in Embodiment 1, to input system-used water amount M (fixed value) to controller 100 before the start of operation.

Figure 5:
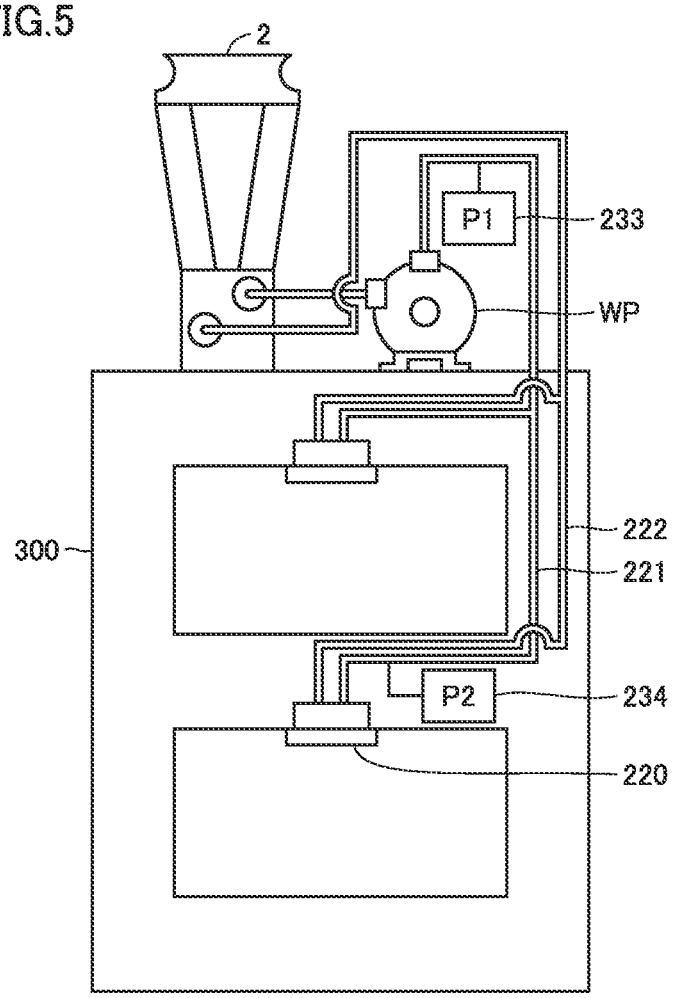
FIG. 5 is a schematic diagram showing a state where a chiller is installed.
Figure 6:
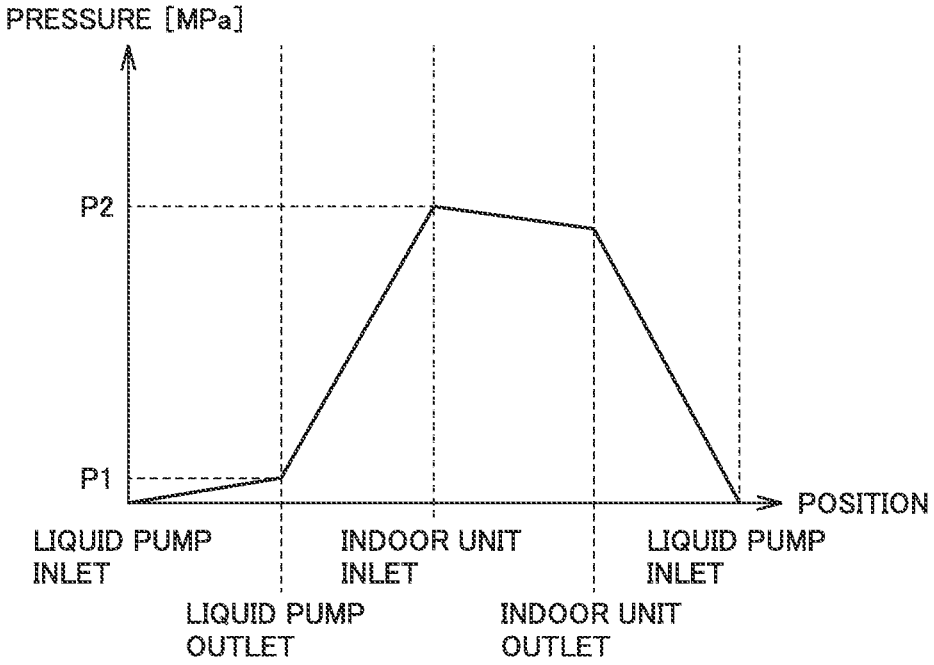
FIG. 6 is a graph showing a pressure distribution in a water pipe.

System-used water amount M can be estimated based on the pressure difference between the inlet and the outlet of liquid pump WP. FIG. 5 is a schematic diagram showing a state where a chiller 2 is installed. FIG. 6 is a graph showing a pressure distribution in a water pipe. As shown in FIGS. 5 and 6, supposing that the liquid pressure at the outlet of the liquid pump is P1 [Mpa] and the pressure at the inlet of the indoor unit is P2, controller 100 calculates system-used water amount M in accordance with the following formula (5).

$$M=(P2-P1)/g*A \quad (5)$$

In formula (5), A [$m^2$] represents the cross-sectional area of a passage in which the liquid medium circulates, ρ [$kg/m^3$] represents the water density, and g [$m/s^2$] represents the acceleration of gravity.

Thus, controller 100 may detect the pressure difference to calculate system-used water amount M, to thereby save the trouble of setting system-used water amount M in installing the air conditioning apparatus, which facilitates construction work.

Figure 7:
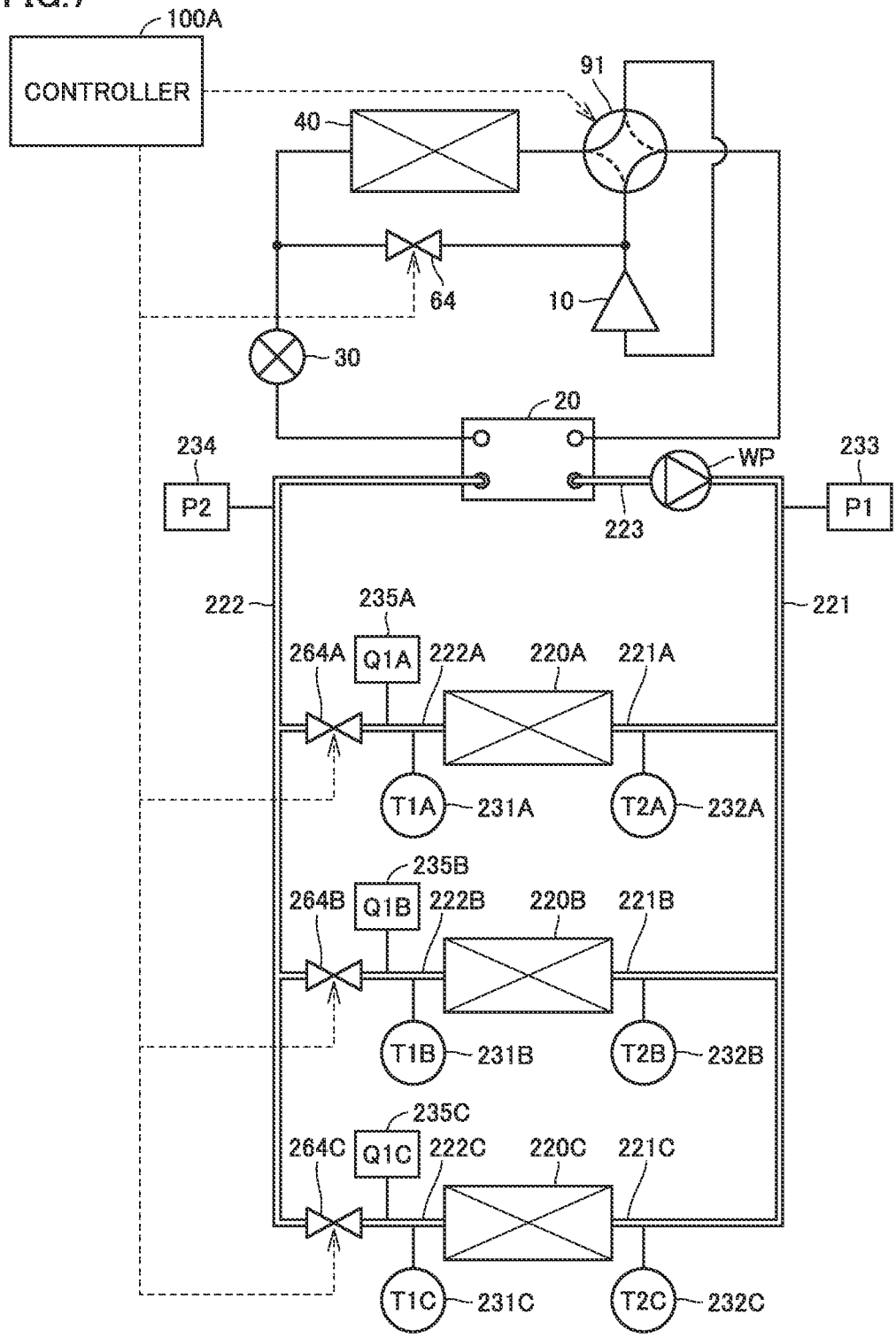
FIG. 7 shows an example of an air conditioning system in which the system-used water amount varies in use.

Moreover, system-used water amount M may vary in use. FIG. 7 shows an example of an air conditioning system in which system-used water amount M varies in use.

In FIG. 7, regarding the portion in which refrigerant circulates (compressor 10, water heat exchanger 20, expansion valve 30, outdoor heat exchanger 40, pipes 90, 92, 94, 96, 97, 98, four-way valve 91, pipe 62, open/close valve 64), the configuration and the operation are similar to those in FIG. 1, and therefore, the description thereof is not repeated herein.

A refrigeration cycle apparatus shown in FIG. 7 includes indoor heat exchangers 220A to 220C connected in parallel to each other, instead of indoor heat exchanger 220 in the configuration in FIG. 1. Indoor heat exchangers 220A to 220C are equipped with temperature sensors 231A to 231C, 232A to 232C, flow rate sensors 235A to 235C, and shutoff valves 264A to 264C, respectively.

Indoor heat exchanger 220A is connected to water pipe 221 by water pipe 221A. Indoor heat exchanger 220A is connected to water pipe 222 by water pipe 222A. Shutoff valve 264A, temperature sensor 231A, and flow rate sensor 235A are disposed on water pipe 222A. Temperature sensor 232A is disposed on water pipe 221A.

Indoor heat exchanger 220B is connected to water pipe 221 by water pipe 221B. Indoor heat exchanger 220B is connected to water pipe 222 by water pipe 222B. Shutoff valve 264B, temperature sensor 231B, and flow rate sensor 235B are disposed on water pipe 222B. Temperature sensor 232B is disposed on water pipe 221B.

Indoor heat exchanger 220C is connected to water pipe 221 by water pipe 221C. Indoor heat exchanger 220C is connected to water pipe 222 by water pipe 222C. Shutoff valve 264C, temperature sensor 231C, and flow rate sensor 235C are disposed on water pipe 222C. Temperature sensor 232C is disposed on water pipe 221C.

Pressure sensor 233 is disposed on water pipe 221 before branching into water pipes 221A to 221C, and pressure sensor 234 is disposed on water pipe 222 after the confluence of water pipes 222A to 222C.

In such a configuration, depending on whether indoor heat exchangers 220A to 220C are used or not, controller 100A opens or closes respective shutoff valves 264A to 264C. When an indoor heat exchanger is to be used, controller 100A opens the shutoff valve associated with the indoor heat exchanger to be used. When an indoor heat exchanger is not to be used, controller 100A closes the shutoff valve associated with the indoor heat exchanger which is not to be used.

As shutoff valve 264A is closed, water does not circulate in water pipes 221A, 222A, and indoor heat exchanger 220A, and therefore, the amount of water circulating in water pipes 221, 222, namely the system-used water amount is decreased accordingly. As shutoff valve 264B is closed, water does not circulate in water pipes 221B, 222B, and indoor heat exchanger 220B, and therefore, the system-used water amount is decreased accordingly. As shutoff valve 264C is closed, water does not circulate in water pipes 221C, 222C, and indoor heat exchanger 220C, and therefore, the system-used water amount is decreased accordingly.

Therefore, when all of shutoff valves 264A to 264C are opened, the system-used water amount is the maximum amount. When any one of the shutoff valves is opened, for example, when shutoff valve 264A is opened and shutoff valves 264B, 264C are closed, the system-used water amount is the minimum amount.

The refrigeration cycle apparatus shown in FIG. 7 is implemented by adding two indoor heat exchangers in parallel to the refrigeration cycle apparatus shown in FIG. 1. Specifically, supposing that indoor heat exchanger 220A corresponds to indoor heat exchanger 220 in FIG. 1, the refrigeration cycle apparatus shown in FIG. 7 further includes indoor heat exchangers 220B, 220C which are configured to exchange heat between a liquid medium and indoor air and in which the liquid medium from liquid pump WP is circulated in parallel with indoor heat exchanger 220A, and further includes shutoff valves 264B, 264C for stopping flow of the liquid medium to second heat exchangers 220B, 220C. While FIG. 7 shows three indoor heat exchangers connected in parallel to each other, the configuration is not limited to this and the number of parallel-connected indoor heat exchangers may be two or more than three.

Based on the magnitude of the indoor load and the system-used water amount, controller 100A selects one of the reverse cycle defrosting mode and the hot-gas defrosting mode for the defrosting operation to be performed. In the reverse cycle defrosting mode, controller 100A controls four-way valve 91 so that refrigerant flows in the same direction as that during the cooling operation, and closes open/close valve 64. In the hot-gas defrosting mode, controller 100A controls four-way valve 91 so that refrigerant flows in the same direction as that during the heating operation, and opens open/close valve 64.

Figure 8:
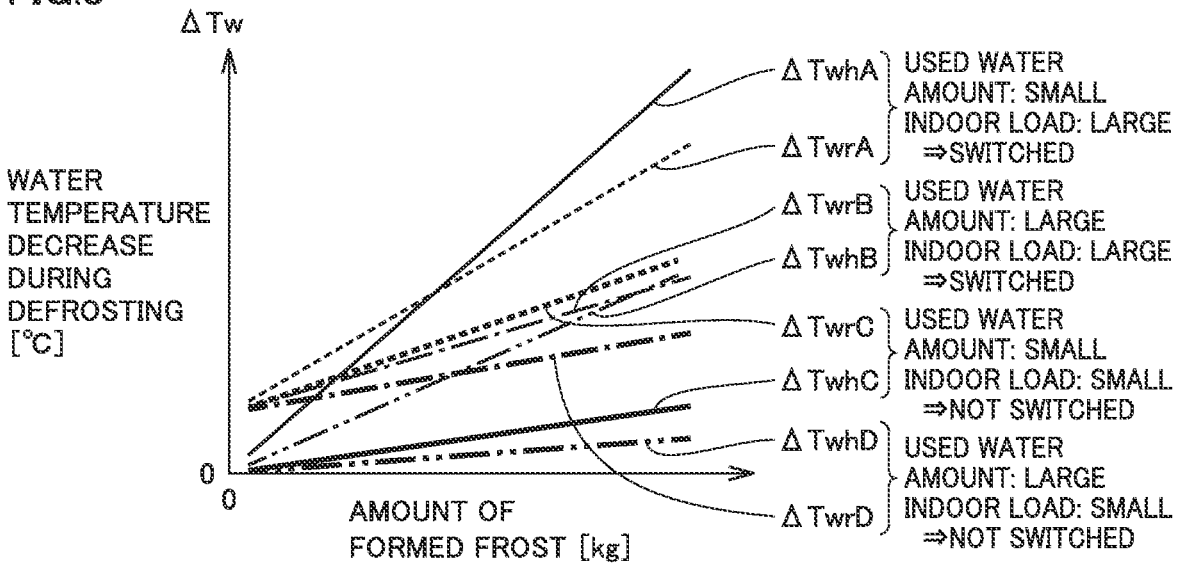
FIG. 8 shows how the water temperature decrease during defrosting varies depending on the system-used water amount and the indoor load.

FIG. 8 shows how the water temperature decrease during defrosting varies depending on the system-used water amount and the indoor load.

FIG. 2 shows that a greater indoor load is accompanied by a greater water temperature decrease during the defrosting operation. FIG. 8 additionally shows that the water temperature tends to be less decreased even during the defrosting operation when the system-used water amount is large. Supposing that the indoor load consumes a certain amount of heat, then a larger amount of water used for heating means that the total amount of heat having been absorbed by water is large, which has a less influence on the water temperature.

Specifically, in FIG. 8, when the system-used water amount is small and the indoor load is large, the water temperature decrease during hot-gas defrosting is represented as ΔTwhA and the water temperature decrease during reverse cycle defrosting is represented as ΔTwrA. The line representing ΔTwhA and the line representing ΔTwrA cross each other at an intersection. Therefore, in order to reduce the water temperature decrease, the defrosting mode is switched based on the amount of formed frost. When a detected amount of formed frost is smaller than the amount of formed frost at the intersection, hot-gas defrosting is used, while reverse cycle defrosting is used when the detected amount of formed frost is larger than the amount of formed frost at the intersection.

When the system-used water amount is large and the indoor load is large, the water temperature decrease during hot-gas defrosting is represented as ΔTwhB and the water temperature decrease during reverse cycle defrosting is represented as ΔTwrB. The line representing ΔTwhB and the line representing ΔTwrB cross each other at an intersection. Therefore, in order to reduce the water temperature decrease, the defrosting mode is switched based on the amount of formed frost. It should be noted that the intersection of the line for ΔTwhB and the line for ΔTwrB is shifted in the direction that the amount of formed frost increases, relative to the intersection of the line for ΔTwhA and the line for ΔTwrA.

In contrast, when the system-used water amount is small and the indoor load is small, the water temperature decrease during hot-gas defrosting is represented as ΔTwhC and the water temperature decrease during reverse cycle defrosting is represented as ΔTwrC. The line representing ΔTwhC and the line representing ΔTwrC do not cross each other. Therefore, the defrosting mode is not switched and the hot-gas defrosting mode is selected.

Likewise, when the system-used water amount is large and the indoor load is small, the water temperature decrease during hot-gas defrosting is represented as ΔTwhD and the water temperature decrease during reverse cycle defrosting is represented as ΔTwrD. The line representing ΔTwhD and the line representing ΔTwrD do not cross each other. Therefore, the defrosting mode is not switched and the hot-gas defrosting mode is selected.

As seen from the above, there is a tendency that the reverse cycle defrosting is likely to be selected when the indoor load is large, while the hot-gas defrosting is likely to be selected when the system-used water amount is large.

Figure 9:
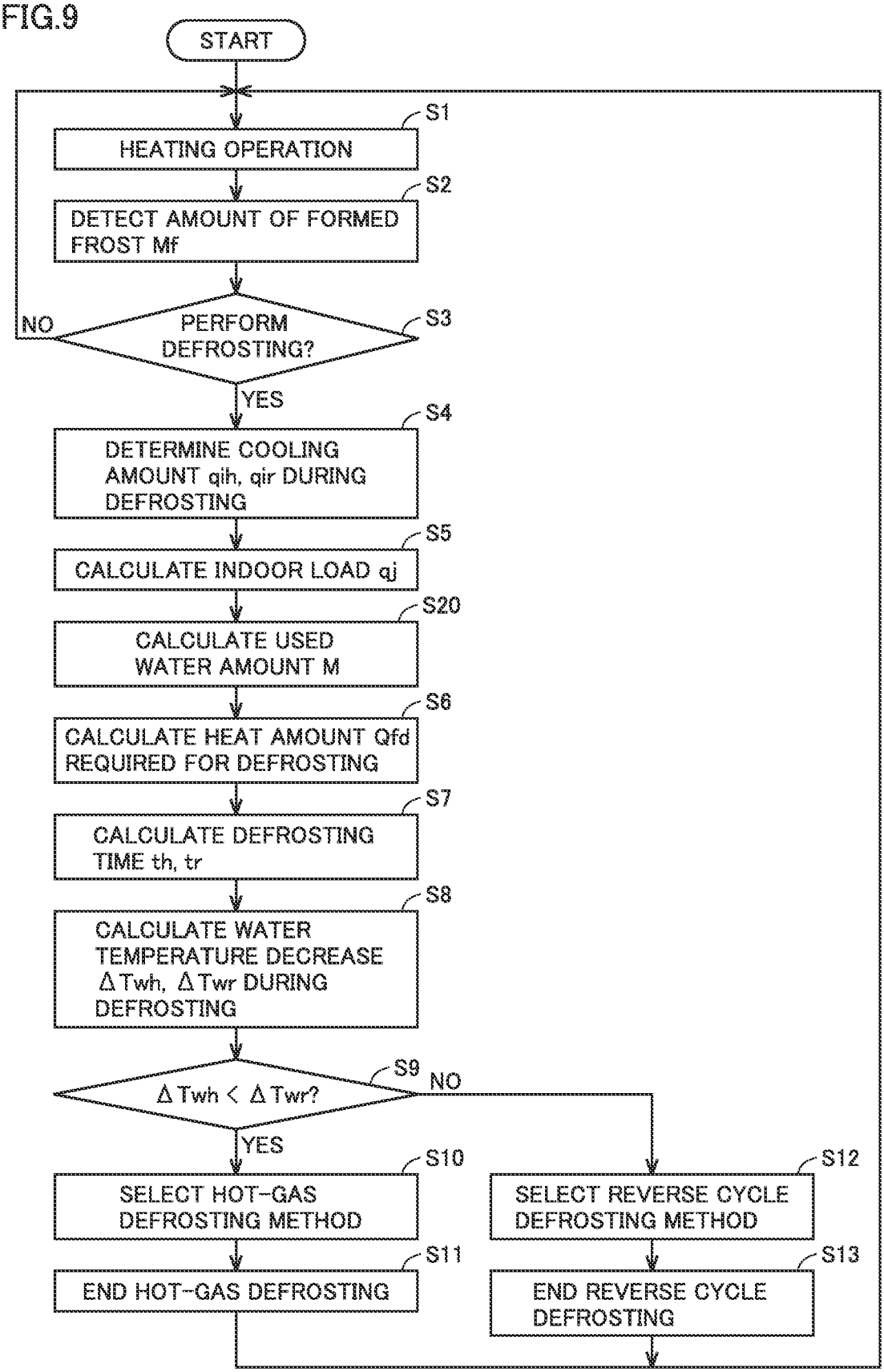
FIG. 9 is a flowchart for illustrating control performed by a controller in Embodiment 2.

FIG. 9 is a flowchart for illustrating control performed by a controller in Embodiment 2. The flowchart in FIG. 9 corresponds to the flowchart described above with reference to FIG. 3 including additional step S20 of calculating used water amount M inserted between step S5 and step S6. The other steps are similar to those shown in FIG. 3, and the description thereof is not repeated.

In step S20, controller 100A calculates system-used water amount M. In the process in FIG. 3, system-used water amount M is a fixed value applied in advance as a design value. In contrast, in the process in FIG. 9, system-used water amount M is calculated in step S20 and used for calculating the water temperature decrease in step S8.

Accordingly, controller 100A selects a defrosting mode based on the indoor load and the system-used water amount in step S9. Controller 100A calculates the system-used water amount in accordance with the above-indicated formula (5). While system-used water amount M may be calculated based on design information and the operating state of the shutoff valve, use of formula (5) eliminates the need to input design information such as the length of the water pipe, for example, and is therefore more preferred. Calculation of system-used water amount M based on the pressure difference between the inlet and the outlet of the liquid pump also eliminates the need to monitor the operating state of the shutoff valve, for example.

It should be construed that embodiments disclosed herein are given by way of illustration in all respects, not by way of limitation. It is intended that the scope of the present invention is defined by claims, not by the description above, and encompasses all modifications and variations equivalent in meaning and scope to the claims.

The invention claimed is:

1. A refrigeration cycle apparatus comprising:

a water heat exchanger configured to cause heat to be exchanged between refrigerant and a liquid medium;

a refrigeration cycle circuit connecting a compressor, the water heat exchanger, an expansion valve, and an outdoor heat exchanger successively and connecting a discharge side of the compressor to a part of the refrigeration cycle circuit between the expansion valve and the outdoor heat exchanger;

a liquid medium circulation circuit connecting the water heat exchanger, a pump, and an indoor heat exchanger; and a controller, the refrigeration cycle circuit comprising:

a four-way valve configured to switch to connect the compressor to the water heat exchanger or to connect the compressor to the outdoor heat exchanger;

a pipe connecting the discharge side of the compressor to the part of the refrigeration cycle circuit between the expansion valve and the outdoor heat exchanger; and a valve configured to block flow of the refrigerant in the pipe, and at least one temperature sensor disposed at the outlet of the indoor heat exchanger to measure an indoor load, wherein the controller is configured to determine, based on the indoor load, which of a first defrosting operation and a second defrosting operation to select to start a defrosting operation, and start the selected defrosting operation, wherein in the first defrosting operation, the controller opens the valve, connects a discharge port of the compressor to the outdoor heat exchanger by the valve, and allows refrigerant discharged from the compressor to flow to the outdoor heat exchanger through the valve, and in the second defrosting operation, the controller closes the valve, connects the discharge port of the compressor to the outdoor heat exchanger by the four-way valve, and allows refrigerant discharged from the compressor to flow to the outdoor heat exchanger through the four-way valve.

2. The refrigeration cycle apparatus according to claim 1, wherein the at least one temperature sensor includes a first temperature sensor and a second temperature sensor configured to detect an outlet temperature of the liquid medium at an outlet of the indoor heat exchanger and an inlet temperature of the liquid medium at an inlet of the indoor heat exchanger, respectively; and the refrigeration cycle apparatus further comprises a first flow rate sensor configured to detect a flow rate of the liquid medium, wherein the defrosting operation is selected based on respective outputs of the first temperature sensor and the second temperature sensor and an output of the first flow rate sensor.

3. The refrigeration cycle apparatus according to claim 2, wherein the indoor load is calculated in accordance with a formula:

$$qj=Q1*(T1-T2)*Cpw$$

where qj [kW] represents the indoor load, Q1 [kg/s] represents the flow rate of the liquid medium, T1 [° C.] represents the inlet temperature, T2 [° C.] represents the outlet temperature, and Cpw [kJ/kg° C.] represents a specific heat of water.

4. The refrigeration cycle apparatus according claim 2, further comprising:

a second indoor heat exchanger configured to cause heat to be exchanged between the liquid medium and indoor air, and allow the liquid medium from the pump to circulate through the second indoor heat exchanger in parallel with the indoor heat exchanger;

a third temperature sensor and a fourth temperature sensor configured to detect an outlet temperature of the liquid medium at an outlet of the second indoor heat exchanger and an inlet temperature of the liquid medium at an inlet of the second indoor heat exchanger, respectively; and a second flow rate sensor configured to detect a flow rate of the liquid medium flowing through the second indoor heat exchanger.

5. The refrigeration cycle apparatus according to claim 1, wherein the defrosting operation is selected based on the indoor load and a system-used water amount, where the system-used water amount is an amount of the liquid medium circulating in the liquid medium circulation circuit.

6. The refrigeration cycle apparatus according to claim 5, wherein the system-used water amount is calculated in accordance with a formula:

$$M=(P2-P1)/g*A$$

where M represents the system-used water amount, P1 [Mpa] represents a liquid pressure at an outlet of the pump, P2 [Mpa] represents a liquid pressure at an inlet of the pump, A [m2] represents a cross-sectional area of a passage in which the liquid medium circulates, and g [m/s2] represents an acceleration of gravity.

7. The refrigeration cycle apparatus according to claim 5, further comprising:

a second indoor heat exchanger configured to cause heat to be exchanged between the liquid medium and indoor air, and allow the liquid medium from the pump to circulate through the second indoor heat exchanger in parallel with the indoor heat exchanger; and a shutoff valve configured to stop flow of the liquid medium to the second indoor heat exchanger.

8. The refrigeration cycle apparatus according to claim 1, wherein the indoor load is calculated in accordance with a formula:

$$qj=Q1*(T1-T2)*Cpw$$

where qj [kW] represents the indoor load, Q1 [kg/s] represents the flow rate of the liquid medium, T1 [° C.] represents the inlet temperature, T2 [° C.] represents the outlet temperature, and Cpw [kJ/kg° C.] represents a specific heat of water.

* * * * *